United States Patent [19]

Ravich

[11] 4,004,711

[45] Jan. 25, 1977

[54] DISPOSABLE TOWEL

[75] Inventor: Leonard E. Ravich, Boston, Mass.

[73] Assignee: Gorham International Inc., Gorham, Maine

[22] Filed: June 16, 1975

[21] Appl. No.: 587,021

Related U.S. Application Data

[62] Division of Ser. No. 341,277, March 14, 1973, Pat. No. 3,889,804.

[52] U.S. Cl. ..... 221/63; 221/150 A

[51] Int. Cl.[2] ..... B65D 83/08; B65H 1/06

[58] Field of Search ..... 206/219, 812; 221/63, 221/150 A

[56] References Cited

UNITED STATES PATENTS

| | | | |
|---|---|---|---|
| 2,115,923 | 5/1938 | Cooper | 221/63 |
| 3,038,473 | 6/1962 | Ladd | 206/222 X |
| 3,343,664 | 9/1967 | Poitras | 206/219 |
| 3,414,927 | 12/1968 | Worcester | 206/812 X |
| 3,638,786 | 2/1972 | Borecki | 206/219 |

OTHER PUBLICATIONS

Chemical Abstracts, vol. 73, 1970, p. 297, 34993y.

*Primary Examiner*—Leonard Summer
*Attorney, Agent, or Firm*—Robert L. Goldberg

[57] ABSTRACT

This invention relates to a disposable wet towel characterized by an ability to evolve heat immediately prior to use or in use such that the temperature of the towel is increased by as much as 25° or more above ambient when applied to the skin. The evolution of heat is due to the admixture of a reducing agent and an oxidizing agent reactive with said reducing agent which agents are kept separated prior to use of the towel and mixed when the towel is put into use. The agents and products resulting from the reaction thereof are not irritating to the skin. The invention also provides pouches for storing said towels prior to use which pouches contain means for maintaining said oxidizing agent and reducing agent isolated from each other.

4 Claims, 4 Drawing Figures

DISPOSABLE TOWEL

This is a division of application Ser. No. 341,277, filed Mar. 14, 1973, which issued as U.S. Pat. No. 3,889,804 on June 17, 1975.

BACKGROUND OF THE INVENTION

This invention relates to wet disposable towels capable of evolving heat upon use to effect a temperature rise.

Wet disposable towels are known in the art. Typically, they are of paper and are stored in an airtight pouch such as an aluminum foil pouch lined with a protective liner such as polyethylene. When desired for use, the pouch is torn open and the wet towel removed. Such towels are usually impregnated with an aqueous solution containing various additives such as perfumes, astringents, humectants and frequently menthol to give a cooling effect when applied to the skin.

SUMMARY OF THE INVENTION

The subject invention provides a wet disposable towel that evolves heat immediately prior to or during use such that it is above ambient temperature when applied to the skin. The evolution of heat is accomplished by bringing together a reducing agent and an oxidizing agent such that an exothermic chemical reaction results. The amount of heat evolved and the corresponding temperature rise is in part determined by the relative concentrations of the oxidizing agent and the reducing agent. The invention also provides pouches for storing said towels prior to use which pouches contain means for maintaining said oxidizing agent and reducing agent separated from each other.

Accordingly, one object of the present invention is to provide a self-heating, hot disposable towel for application to the skin.

Another object is to provide a towel impregnated with a two part aqueous solution, one part of which contains an oxidant and the other part of which contains a reducing agent reactive therewith such that upon mixing of the two parts, there is the evolution of heat.

A further object of the invention is to provide a pouch containing a towel, an aqueous solution of an oxidizing agent and an aqueous solution of a reducing agent reactive with said oxidizing agent to produce heat, said pouch characterized by means to maintain said oxidizing agent and reducing agent separate from each other.

Other objects and advantages of the invention will be in part apparent from the description which follows:

DESCRIPTION OF THE PREFERRED EMBODIMENTS

Figure 1:
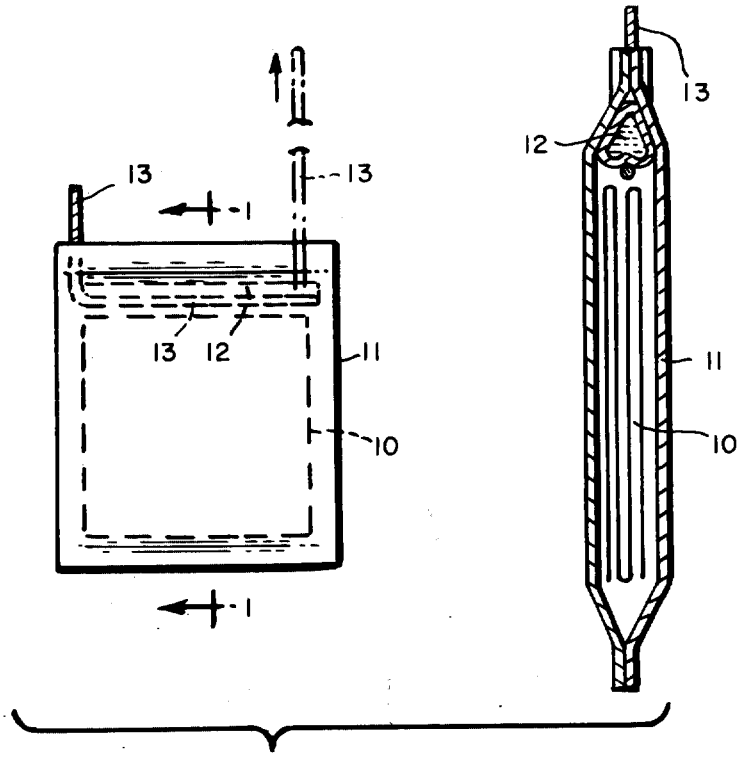
FIG. 1 represents both a front view and a cross-sectional view of a pouch containing a towel in accordance with one embodiment of the invention.

The material used for the towel and the pouch containing said towel are in accordance with the materials of the prior art. Thus, paper is the preferred towel material though cloth or a non-woven fabric may be used and a foil such as aluminum foil lined with polyethlene, for example, is the preferred pouch material. The pouch must be airtight.

In order to obtain a heat rise immediately prior to or during use of the towel of the invention, there are brought together two solutions in contact with the towel which undergo an exothermic chemical reaction. In accordance with the invention, these materials are an oxidizing agent and a reducing agent, said agents being reactive with each other.

The oxidizing agent may be any one of a wide variety of materials depending upon the precise requirement of the particular composition in which it is used. Among the oxidants that may be used are hydrogen peroxide, urea hydrogen peroxide, sodium peroxide, sodium perborate, sodium persulfate, ammonium persulfate, potassium persulfate and mixtures of the foregoing.

The quantity of oxidizing agent and reducing agent contained in the liquid composition impregnated into the hot towel will depend in part upon how much heat is desired and in part upon the nature of the by-products which may result from the reaction. It is generally desirable that the amount of reducing agent be at least as great as the amount required for stochiometric reaction with all of the oxidizing agent present in the liquid composition. It is generally preferred that 5 to 10 mole per cent excess of the reducing agent by present in order to insure complete reaction of all of the oxidizing agent. In some cases, however, the quantity of the oxidizing agent initially present may be greater than the stochiometric quantity required for reaction with all of the reducing agent because, due to the nature of the reducing agent, it may be desirable to insure complete utilization thereof. In these cases, up to 10 mole percent excess oxidant may be employed, said oxidant being consumed preferably within 15 seconds when used with a mixture of a reducing agent, catalyst for the reaction and other materials. Both the oxidizing agent and reducing agent, as well as the by-products formed from said reaction, should be harmless to the skin.

The concentration of the oxidizing agent and reducing agent in the total aqueous composition impregnated into the towel will depend upon the amount of heat required to heat up the composition and towel, and the rate at which the heat is dissipated. As little as 0.8 percent by weight of oxidant based upon the total weight of the aqueous composition impregnating the towel will suffice when a stochiometrically equivalent quantity of reducing agent is used. However, at least 1 percent is preferred and in general, the amount is that amount necessary to heat the towel at least 25° F, above ambient temperature. As the proportion of the oxidizing agent and reducing agent is increased, the rate of heat generation approaches a maximum which varies depending upon the particular materials used. Once the maximum rate of heating has been achieved, further increase in the amount of oxidizing agent and reducing agent has no substantial further effect on the heating rate although the total quantity of heat evolved and hence the ultimate temperature to which the hot towel is heated may still increase. In the case of hydrogen peroxide or urea hydrogen peroxide, which materials are the preferred oxidants, it is desirable to avoid concentrations above 10 percent by weight.

It is desirable to have present in the part of the composition containing oxidants, especially peroxides, conventional stabilizers such as phenacetin, stannates and acid phosphates in order to ensure stability of the oxidant solution during storage.

Because of the special characteristics required of compositions applied to the skin, there are only a limited number of reducing agents which may be employed. These characterisitics include an ability to react with the oxidizing agent to provide rapid and adequate heat evolution, stability during normal storage, freedom from objectionable color and odor, freedom from toxicity, from physiological activity, from irritancy and sensitization. As noted above, the amount of heat evolved preferably is sufficient to raise the temperature of the entire composition impregnating the towel by approximately 25° F. above ambient temperature during a period of 30 seconds preferably 15 seconds or less after mixing. Although there exists a substantial number of reductants which exhibit the first three of the foregoing characteristics, most of them lack to an appreciable extent one or more of the remaining characteristics. The reductants which have been found to possess all of the foregoing characteristics are thiourea and compounds having the structure

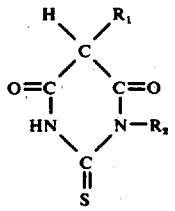

in which $R_1$ may be hydrogen, lower alkyl, lower hydroxy alkyl, lower alkoxy, or lower alkanoyl, and $R_2$ may be any of the foregoing except hydrogen and may in addition be phenyl. Among such compounds are 1-phenyl-2-thiobarbituric acid, 1-phenyl-5-ethyl-2-thiobarbituric acid, 1-methyl-2-thiobarbituric acid, 1-methyl-5-ethyl-2-thiobarbituric acid 1-methyl-5-ethyl-2-thiobarbituric acid, 1-ethyl-5-ethyl-2-thiobarbituric acid, 1-phenyl-5-methyl-2-thiobarbituric acid, and the like, all of which are soluble in weakly alkaline aqueous media. The oxidants which may be used with the foregoing reductants to produce the desired results include hydrogen peroxide and urea hydrogen peroxide.

Preferably, the oxidant is present in an amount from 0.8 to about 2 percent by weight of the total aqueous composition. The proportions of oxidant and reductant relative to each other are usually adjusted as described above to insure complete reaction of the oxidant with a small amount of excess reductant of the order to 5 to 10 percent of the total quantity of reductant. However in some cases an excess of oxidant may be used, as pointed out above.

The preferred compositions also include a catalyst to accelerate the reaction and hence to accelerate the rise in temperature or the composition, although in some cases it is possible to achieve the same result by employing an excess of reductant. While a variety of catalysts which accelerate such oxidation-reduction reactions are well known and may be used, best results are achieved with such water soluble tungstates or molybdates as alkali metal (including ammonium) tungstates or molybdates, e.g., sodium tungstate, potassium tungstate, sodium molybdate, ammonium molybdate, etc. which not only accelerate the reaction, but also cause it to flow a different course than that followed in the absence of catalyst, at least in the case when thiourea is the reductant, so that there are not produced the objectionable end products which are formed in the absence of catalyst when thiourea is used.

The amount of catalyst required varies with the particular catalyst employed and also with the specific oxidant and reductant present. However, in the case of the preferred tungstate catalyst, the quantity of catalyst for best results is approximately $75 \times 10^{-3}$gram atoms of tungsten per mole of reductant, while in the case of molybdates approximately $17.5 \times 10^{-3}$gram atoms of molybdenum per mole of the reductant is best. As little as half as much of the catalyst may be used successfully. Excess catalyst may be used though the additional quantity has very little effect. Inasmuch as the catalyst promotes decomposition of the oxidant, it should be kept separated therefrom until immediately before mixing of the two parts of the composition. Therefore, the catalyst is preferably included in that part of the composition containing the reducing agent.

The pH of the composition may be in the range of from 5 to 10. For optimum results the pH should be in the range of from 7.5 to 8. In order to maintain the composition within the desired pH range, it may be necessary to include a buffer in the composition.

While a wide variety of alkaline agents or buffers may be used to control pH, such as sodium, potassium or ammonium hydroxide or sodium, potassium, calcium or ammonium carbonate or bicarbonate, best results and minimum irritation of the skin are obtained by using a lower polyalkanolamine such as diethanolamine, di-isopropanolamine, triethanolamine, or tri-isopropanolamine. It has been found permissible to have an excess of one of the preferred polyalkanolamine materials present over and above the minimum required to maintain the desired pH, the excess preferably amounting to up to five percent by weight of the total aqueous composition.

In addition to the ingredients noted above and the composition impregnated into the towel, other ingredients normally used in the manufacture of wet disposable towels such as astringents, humectants, perfumes and the like may be present in the composition.

As noted above, prior to use, the reducing agent and the oxidizing agent are kept isolated from each other. This is accomplished by use of any of the especially designed pouches for the disposable towel illustrated in the drawings though the drawings should not be considered limiting of the various embodiments possible. With reference to FIG. 1 of the drawings, there is shown a folded paper towel 10 impregnated with a solution of a suitable reducing agent and contained in a waterproof and airtight pouch 11. A pod 12 contains an aqueous solution of a suitable oxidant along with stabilizers for said oxidant. When ready for use, a thread 13 is pulled to rupture pod 12 resulting in release of the oxidant and the admixture of the same with the reducing agent impregnated in the towel 10. An exothermic reaction is initiated which will raise the temperature of the towel about 25° F. above ambient. After a few seconds, preferably about 10 seconds, the pouch can be ripped open and the towel used.

Figure 2:
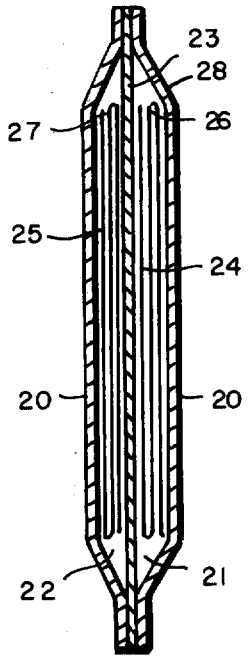
FIG. 2 represents a cross-sectional view of a pouch containing a towel in accordance with an alternative embodiment of the invention.

In FIG. 2 of the drawings, there is represented a variation of the pouch disclosed in FIG. 1. In this embodiment, foil pouch 20 lined with polyethylene is divided into 2 sections 21 and 22 by divider 23. Section 21 contains a folded paper towel, a towel of a non-woven fabric or a cloth towel 24 impregnated with a solution of a suitable reducing agent along with perfumes, humectants, stabilizers and other materials as desired. Towel 25 in compartment 22 is impregnated with a suitable oxidant and stabilizer. The edges 26 and 27 of towel 24 and 25 are so arranged that when pouch 20 is torn such as at location 28, the two towels can be pulled from the pouch together to provide intimate contact with each other and initiate the evolution of heat in accordance with the invention.

Figure 3:
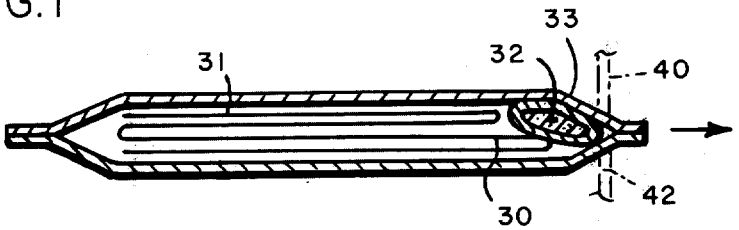
FIG. 3 represents still another cross-sectional view of a pouch in accordance with a further embodiment of the invention.

FIG. 3 is a third alternative wherein there is provided pouch 30 containing a folded towel 31 impregnated with a solution of a reducing agent and any other desired additive. A pod 32 contains an oxidizing agent in a gel form. When the pouch is torn at location 33, the towel 31 is passed through the oxidizing gel to initiate the exothermic reaction or, alternatively, the pod is ruptured and the oxidizing gel squeezed onto the towel as described with reference to a dispenser pack shown in FIG. 4 below.

Figure 4:
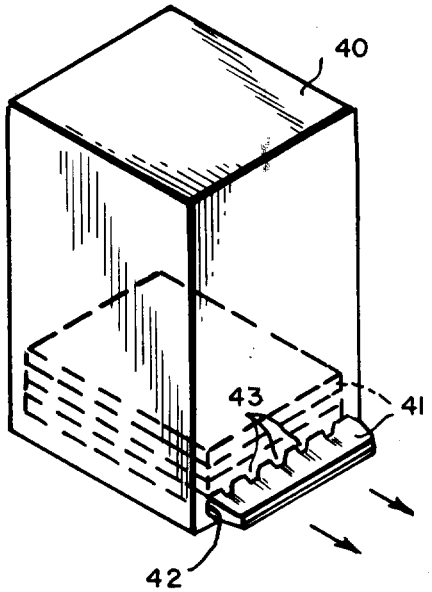
FIG. 4 represents a dispenser for said pouches containing said towels.

In FIG. 4 of the drawing, there is represented a dispenser pack for both storing pouches containing the paper towel and for removing the pouches when desired to use the same. The dispenser pack comprises a rectangular box 40 having stored therein pouches 41 stacked one upon the other. The dispenser pack is provided with a slot 42 near the bottom thereof which slot is sized to accommodate the removal of the pouch 41. The slot 42 has projections 43 extending downward and into the slot such that it constricts the opening. In this way, as the pouch 41 is removed from slot 42, the projections 43 make identations on the pouch which will act to rupture a pod (such as the pod of FIG. 3) containing an oxidizing gel and spread the same over the towel so that the two components mix together initiating the exothermic reaction. These projections 43 can be provided by putting a metal strip across the top of the slit, metal being used because of its strength. A serrated edge (not shown) or any other means to rupture the pod within the pouch can be substituted for projections 43.

The following specific examples are intended to illustrate more fully the invention, but are not intended to limit its scope.

EXAMPLE 1

A first solution of a reducing agent is prepared having the following composition in parts by weight:

| Ingredients | Parts |
|---|---|
| Thiourea | 1.52 |
| Sodium tungstate dihydrate | 0.52 |
| Triethanolamine | 1.00 |
| Perfume | 0.39 |
| Water | 96.57 |

The second part consists of an aqueous solution containing 8.2 percent hydrogen peroxide by weight together with the usual amounts of sodium stannate and phenacetin as stabilizers.

A paper towel was impregnated with the first solution of the reducing agent. The paper towel was folded and inserted into an aluminum foil pouch lined with polyethylene. A pod within the pouch was filled with the second solution of the oxidizing agent. The ratio of the aqueous composition comprising the reducing agent to the composition comprising the oxidizing agent was 3 to 1. The pouch was sealed. Thereafter, the pod in the aluminum foil packet was ruptured by squeezing and opened. The paper towel immediately began to heat and the temperature of the towel was raised to about 100° F.

EXAMPLE 2

A reducing agent composition was prepared having ingredients as follows:

| Ingredients | Parts |
|---|---|
| 1-phenyl-5-ethyl-2-thiobarbituric acid | 5.00 |
| Ammonium molybdate tetrahydrate | 0.06 |
| Triethanolamine | 1.00 |
| Perfume | 0.39 |
| Distilled Water | 93.55 |

The oxidizing solution was the same as in Example 1. The procedure of Example 1 was repeated and the rise in temperature of the towel was to about 105° F.

Similar results are obtained using as the reducing agent a molar equivalent amount of 1-methyl-2-thiobarbituric acid in place of 1-phenyl-5-ethyl-2-thiobarbituric acid.

EXAMPLE 3

A reducing composition is made having the following formulation:

| Ingredients | Parts |
|---|---|
| Triethanolamine | 1.0 |
| 1-phenyl-2-thiobarbituric acid | 4.8 |
| Sodium tungstate dihydrate | 0.5 |
| Water | 93.7 |

The second part consisted of an aqueous solution containing 7.9% hydrogen peroxide by weight together with the usual amount of sodium stannate and phenacetin.

Following the procedure of Example 1, upon mixing of the two parts in proportion of three parts by weight of the reducing solution to one part by weight of the oxidizing solution at room temperature, the towel underwent a temperature rise of about 130° F.

I claim:

1. In combination, a stack of pouches, one on top of another, in a container of size and shape to accommodate said stack of pouches, each of said pouches containing a towel, a solution of an oxidizing agent and a solution of a reducing agent, said solution of reducing agent being isolated from said solution of oxidizing agent, at least one of said solution of reducing agent and oxidizing agent being contained within a rupturable pod within said pouch, said container having a slit of a size and shape permitting removal of one of said pouches from said container by sliding the same through said slit, said slit having means to rupture said rupturable pod whereupon, with removal of said pouch from said container, said pod is ruptured and said solution of oxidizing agent mixes with said solution of reducing agent in contact with said towel and an exothermic reaction is initiated.

2. The combination of claim 1 where said means to rupture the rupturable pod is at least one projection extending into said slit.

3. The combination of claim 2 wherein said projection is of metal.

4. The combination of claim 1 where the solution of oxidizing agent is in the rupturable pod.

* * * * *